United States Patent [19]

Varghese

[11] 4,427,532

[45] Jan. 24, 1984

[54] COKING OF COAL WITH PETROLEUM RESIDUA

[75] Inventor: Philip Varghese, Newtown, Pa.

[73] Assignee: Mobil Oil Corporation, New York, N.Y.

[21] Appl. No.: 425,364

[22] Filed: Sep. 28, 1982

[51] Int. Cl.[3] ..... C10B 55/00; C10G 69/06

[52] U.S. Cl. ..... 208/50; 208/8 LE; 208/107; 208/131

[58] Field of Search ..... 208/50, 8 LE, 107, 131

[56] References Cited

U.S. PATENT DOCUMENTS

| | | | |
|---|---|---|---|
| 1,986,593 | 5/1931 | Morrell | 208/50 |
| 4,039,426 | 8/1977 | Schutte | 208/50 |
| 4,066,532 | 1/1978 | Garcia | 208/131 |
| 4,221,654 | 9/1980 | Stein et al. | 208/15 |
| 4,244,805 | 1/1981 | Metrailer | 208/50 |
| 4,312,742 | 1/1982 | Hayashi | 208/131 |
| 4,390,409 | 6/1983 | Audeh | 208/8 LE |
| 4,390,410 | 6/1983 | Audeh | 208/8 LE |

*Primary Examiner*—Delbert E. Gantz
*Assistant Examiner*—Lance Johnson
*Attorney, Agent, or Firm*—A. J. McKillop; Michael G. Gilman; Lowell G. Wise

[57] ABSTRACT

A hydrotreated petroleum residuum is coked in the presence of coal to improve the yield and quality of the liquid coker products. The coal is preferably of low rank with a carbon content below 75 weight percent with best results being obtained with sub-butuminous coals. The coke product may also be of improved purity, especially with respect to sulfur and metal (especially Ni, V) content.

13 Claims, 1 Drawing Figure

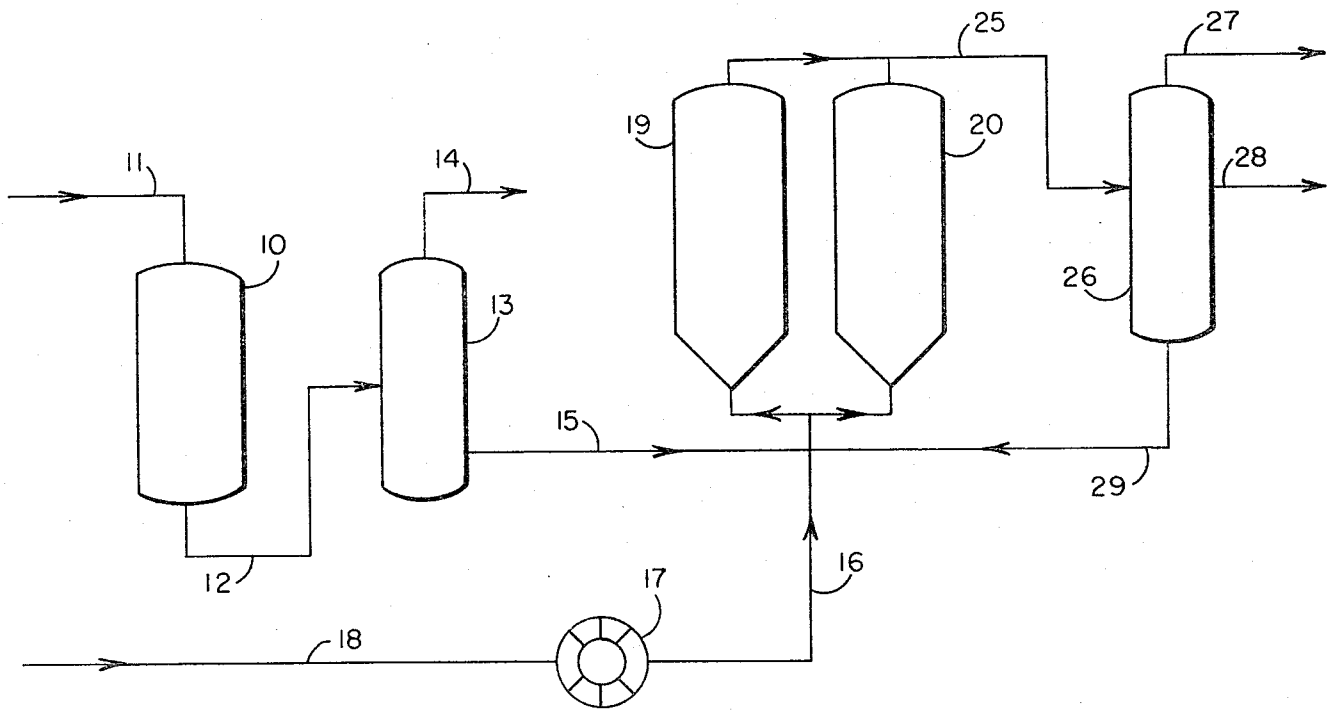
10
11
12
13
14
15
16
17
18
19
20
25
26
27
28
29

COKING OF COAL WITH PETROLEUM RESIDUA

FIELD OF THE INVENTION

This invention relates to a process for coking coal with petroleum residua.

BACKGROUND OF THE INVENTION

Coking processes, especially the delayed coking process, provide a way of converting high boiling and refractory petroleum residua to more valuable, lower-boiling products with petroleum coke being obtained as a by-product. In recent years, it has been found that it may be desirable to subject the coker feedstock or a recycle stream to hydrotreating in order to improve the operation of the process or to obtain products of better quality. For example, hydrotreating in this way may bring about a decrease in coke yield with a consequent increase in the liquid and gas product and in the coker throughput; it may also result in a coke product of higher purity with a reduced heteroatom content which may be sold as higher value metallurgical or electrode grade material. U.S. Pat. No. 4,213,846, for example, describes a process in which the recycled gas oil from the coker is hydrotreated to produce a premium type coke. U.S. Pat. Nos. 3,684,688, 3,617,481 and 3,891,538 also describe the use of hydrotreating in combination with coking processes.

Processes have also been proposed for carrying out coking in the presence of coal, coal chars, carbon fines and other solids. U.S. Pat. Nos. 2,717,865, 2,775,546, 2,899,376, 3,673,080 and 4,082,650 describe processes of this kind. U.S. Pat. No. 4,259,178 describes a process for the delayed coking of heavy petroleum residual materials blended with a coking or non-coking coal. The coke product is stated to be of a softer and more porous, friable quality.

Contemporary coditions in the world petroleum market have made it desirable to improve the useful liquid yield from coking and other residual treatment processes in order to maximize the yield of economically valuable products such as distillates and gasoline. At the same time, it has become desirable for countries with major coal reserves to utilize that resource to a greater extent than in the past and this, in general, means that improved coal liquefaction and gasification processes must be found for producing liquid and gaseous fuels which are more desirable than solid fuels which, by and large, can be used effectively only in large installations such as electrical power plants.

SUMMARY OF THE INVENTION

The present invention provides a process in which hydrotreated residual materials are co-processed with coal. The process is capable not only of reducing the coke yield (and therefore of increasing the coker throughput), of producing a better yield of coker liquids and a coke product of higher purity, but also of converting the added coal to desirable liquid products. The improvement in liquid yield is notable since it is greater than would be obtained soley by the use of hydrotreating. In addition, the coke is of even lower sulfur and metals content and of improved reactivity and amenability to combustion or gasification in comparison with conventional petroleum cokes. The liquid product is also of improved quality as compared to the liquid product obtained by coking the residual material on its own in the absence of added coal; the improvement in this respect is manifested particularly by a lower sulfur content in the liquid product.

According to the present invention, a hydrotreated residual feedstock is subjected to coking in the presence of coal. The preferred coals are low rank coals such as lignite or sub-bituminous coal; the preferred residual feedstocks are catalytically hydrotreated petroleum residua, although residua derived from other sources such as shale oil, tar sands and coal may also be used. Various coking processes may be used, including delayed coking, fluid coking and contact coking.

DRAWINGS

The single FIGURE of the accompanying drawings is a simplified schematic flowsheet showing the operation of the process, employing a delayed coking step.

PREFERRED EMBODIMENTS OF THE INVENTION

General Process Considerations

The process may be operated in a manner similar to that illustrated in simplified, schematic form in the FIGURE which, for convenience, illustrates the use of a delayed coking process. A heavy petroleum resid is fed into hydrotreater 10 through feed pipe 11. After passing through the hydrotreater the resid is passed through pipe 12 to fractionating tower 13 where any low boiling fractions such as distillate range material may be removed as overheads through conduit 14. The heteroatom content of the resid (nitrogen, sulfur, oxygen) which has been converted to inorganic form as ammonia, hydrogen sulfide or water in the hydrotreater may also be removed as overheads at this stage or, alternatively, may be removed by a preliminary scrubbing step of the kind that is conventional for hydrotreating processes. The fractionated resid which forms the coker feed then passes along pipe 15 to the coker drums 19 and 20 in which delayed coking takes place. Before entering one coker drum or the other, the coker feed is mixed with comminuted coal from feed conduit 16 connected to a coal pulverizing mill 17 or another convenient source of finely ground coal particles. Mill 17 may be fed with coal from a suitable storage by means of conduit 18. Mixing of the finely comminuted coal with the liquid coker feed may be ensured by the use of a mill or other conventional device (not shown).

The blend of liquid coker feed and comminuted coal is fed into one of the two coker drums, 19 and 20, the other drum being the "swing" drum which is emptied of its coke as the first drum is being filled, typically over a one day period. Additional drums may, of course, be provided in order to provide sufficient coking capacity or flexibility of operation The feed to the drum or drums in use may be regulated by means of suitable valving devices (not shown). In the delayed coker drum, the feed undergoes coking to form a solid mass of coke which remains in the drum together with liquid and gaseous coking products which are removed as coker products through pipe 25. Removal of the volatile coker products may be assisted by steam stripping in the normal way.

The coker products are fractionated in tower 26 with gases removed as overheads through take-off 27 and liquid products through take-off 28. The coker residual product is recycled to the coker drums by way of recycle line 29.

Materials

The feedstock for the process comprises a residual material, for example, a vacuum tower residue, fractionator residue, reduced crude, decant oil, thermal tar, FCC tower bottoms or other heavy oils and residual materials such as bitumens. Typically, residues of this kind have an initial boiling point over 480° C. (about 900° F.) or even higher, e.g., 540° C.+ (1000° F.+). These resids are characterized by a high carbon content which is normally at least 5 and, in most cases, 5 to 50 weight percent Conradson Carbon Residue (CCR). The API gravity of the resid will normally be −10 to +20. The resid may be derived from petroleum or other sources of liquids which are principally composed of hydrocarbons, for example, tar sands bitumens such as the Athabasca tar sands bitumens, shale oil, coal tar liquids or Fischer-Tropsch liquids. The process has been found to give particularly good product improvements with feedstocks containing high proportions of heteroatoms such as nitrogen and sulfur; highly nitrogenous feeds such as shale oil resids exhibit a marked reduction in nitrogen content when treated by the present process.

The coal may be of any rank but the lower rank coals are preferred, especially the bituminous and sub-bituminous coals. It has been found that the improvement in quality of the liquid product from the process becomes progressively greater with the use of coals of successively lower rank and for this reason, the sub-bituminous coals are preferred and correspondingly favorable results may be expected with lignite. The preferred coals normally contain not more than 85 weight percent carbon and preferably not more than 75 weight percent carbon. Carbon contents of 60 to 75 weight percent are preferred (carbon contents are given on a dry, ash-free basis). Correspondingly, the oxygen content is preferably above 7 weight percent (dry, ash-free basis) and normally should be 7 to 30 weight percent, preferably 15 to 30 weight percent. It is believed that it is the oxygen content of the coal which leads to the scavenging of the heteroatoms such as nitrogen and sulfur from the resid and for this reason, the oxygen content of the coal may be of significance in making the selection among the coals which are suitable. The hard coals such as steam coal and anthracite will not normally be preferred since it has been found that they do not bring about as great a reduction in sulfur content of the liquid coker products as the softer coals, especially those of sub-bituminous rank. The hydrogen content of the preferred coals will normally be at least 4.5 weight percent and in most cases as least 5 weight percent, although some lignites and some of the harder bituminous coals will have hydrogen contents at the lower end of this preferred range.

The sulfur content of the coal should be limited, so far as is possible and economic, in order to obtain a coke product of low sulfur content and also to prevent the liquid products from acquiring any undesired sulfur content. It is recommended that the sulfur content of the coal should not exceed 1.5 weight percent (dry, ash-free basis) and preferably should not exceed 0.7 weight percent. The nitrogen content is not as significant and in most cases will be below 1.6 weight percent (dry, ash-free basis), more usually from 1.2 to 1.6 weight percent.

Process Conditions

The resid will be treated according to conventional hydrotreating conditions in order to reduce its content of heteroatoms including nitrogen and sulfur. Normally, the heated resid will be passed over a hydrotreating catalyst in the presence of hydroen and a suitable catalyst at an elevated temperature and pressure typically 300° to 450° C. (about 570° to 840° F.), more usually 320° to 400° C. (about 610° to 750° F.), at total system pressures of at least 3000 and more usually 7000 to 15000 kPa (at least about 420, more usually about 1000 to 2160 psig) with space velocities of 0.1 to 2 $hr.^{-1}$, more usually 0.5 to 2 $hr.^{-1}$, LHSV. The hydrogen circulation rate will normally be from 200 to 1000 $w.l.l.^{-1}$ of resid (about 1120 to 5620 SCF/Bbl). The catalysts used for hydrotreating are of a bifunctional kind having both acidic and hydrogenation activity. The acidic functionality in resid hydrotreating catalysts is normally provided by a highly porous, solid acidic support such as alumina or silica-alumina but may be provided by a crystalline zeolite, especially the large pore zeolites such as zeolites X or Y. The zeolite may be composited with another material such as alumina or silica-alumina or an amorphous clay as a matrix and is preferably used in a stabilized cationic form such as the magnesium form. The hydrogenation component is typically a transition metal of Groups VA, VIA or VIIIA or the Periodic Table (IUPAC Table as shown, for example, in the Periodic Chart of the Fisher Scientific Company, Catalog No. 4-702-10). Since the feed may contain sulfur and nitrogen compounds, the base metals will be preferred over the noble metals, with nickel, cobalt, molybdenum, tungsten, vanadium being preferred, especially in the form of combinations such as nickel-cobalt, cobalt-molybdenum, nickel-tungsten or nickel-tungsten-vanadium. Hydrotreating catalysts of these kinds are well known and are commercially available.

During the hydrotreating step the heteroatom containing impurities are subjected to ring opening reactions so that the heteroatoms nitrogen, sulfur and oxygen become converted to inorganic, hydrogenated forms, ammonia, hydrogen sulfide and water which may be removed by scrubbing or simply allowed to pass out of the fractionator 13 with the overheads which are produced by the small extent of cracking which takes place in the hydrotreater. The overhead gas together with light cracking products, e.g., gasoline or distillate, may be used elsewhere. Because the sulfur contents of the liquid and solid products from the coking step may be reduced by the use of the coal, milder hydrotreating conditions, than would otherwise be necessary, will suffice to meet sulfur specifications for these products.

The hydrotreated resid, after fractionation, is mixed with the comminuted coal before being passed to the coking step. Mixing of the coal with the resid may be promoted by maintaining the resid at a high temperature so as to reduce its viscosity, by the use of a mill or other blending devices such as paddle stirrers. The coal is suitably comminuted to a particle size not greater than 40 mesh (U.S. Standard Sieve Series) with most of the material being −200 mesh. The ratio of resid to coal is generally in the range 0.5:1 to 10:1, preferably 2.5:1 to 10:1, by weight.

The blend of coal and resid is then preheated to a suitable temperature for coking, typically at least 400° C. (about 750° F.) and more usually above 450° C.

(about 840° F.). The preheated blend of coal and resid is then subjected to a coking process. Various conventional coking processes may be used including delayed coking, fluid coking and contact coking. The invention is described below with reference to a delayed coking process but the same considerations will, in general, apply to the other coking processes also.

When the delayed coking process is used, the blend of coal and resid is transferred to the drum in which the coking occurs in the carbonizing mass in the lower portion of the coker drum during the delayed residence of the heated feed in the drum, usually for a period of about twenty-four hours. At the start of the coking reaction the drum is empty and it is gradually filled during the course of the coking reaction until the mass of coke approaches the top of the drum. The coking reaction takes place at temperatures of about 450° to 500° C. and under mildly elevated pressures, typically 100 to 1000 kPa. The temperature, pressure and other conditions may be adjusted to maximize the yield of the desired liquid products which are formed during the reaction and which may be removed by steam stripping as the reaction proceeds. At the end of the coking reaction, the coke which is left behind in the drum, is removed while the feed is switched to another drum. During the coking reaction, coker liquids and gaseous products will be produced by the classic coker reactions from the resid. The coal will also be subjected to coking and will form liquid and gaseous products which will pass off from the coker drum or will be released during steam stripping. In addition, the presence of the coal will affect the reactions which take place with the resid. The sulfur level of the liquid products from the coker is reduced to a level below what it would be if the coking were carried out in the absence of the coal and this, moreover, is achieved with a net reduction in coke yield. Thus, not only does the coal yield valuable liquid products itself, but it also contributes to the improvement of the liquid products derived from the resid. The extent of the improvement in liquid yield and quality depends in part upon the nature of the resid and the coal and also upon the relative amounts of resid and coal employed. The optimum amounts for the respective ingredients may be found by suitable experiment once the selection of materials has been made.

The coker products removed as overheads from the coker drums are separated in the fractionator with the coker resid being returned as recycle for blending with fresh coker feed and coal. Gaseous and liquid coker products are taken off higher up the tower and passes to utilization. The recycle stream will typically constitute from 20 to 40, more usually 25 to 30, weight percent of liquid coker feed. The coke may be removed from the coker drums in the normal way, e.g., by hydraulic devices.

The conditions used in other types of coking, e.g. fluid coking, will generally follow the conditions appropriate to those types of process.

The present process affords an excellent way of integrating coal utilization into existing refinery operations. With present trends towards the use of coal as a refinery fuel, the present process will offer even greater advantages because the coal may first be processed with the resid to obtain high quality liquid products and the coke by-product itself used as a refinery fuel. Because the coke has a heating value about half as great again as a typical sub-bituminous coal in a weight basis (typically, about 34000 kJ. $kg^{-1}$ (about 14000 BTU/lb) as against about 26000 kJ. $kg^{-1}$ (about 11000 BTU/lb) for the coal itself), the conversion is by no means unattractive even if the contribution to the liquid yield is neglected. An added advantage of using low rank coals is that a relatively large improvement in heating value is obtained by reason of the reductions in moisture and oxygen content of these coals; furthermore, it is believed that the oxygen content of these coals assists in the scavenging process, resulting in a purer liquid product. Furthermore, the coke produced by the present process is more porous and friable and has a higher surface area than typical petroleum cokes and can therefore be more easily burned than they can be, rendering it more suitable as a fuel. Even though the coal helps to purify the liquid products it is possible, by suitable choice of conditions, to produce a coke product which is within conventional specifications for solid fuels. Finally, the present process, making use of existing refinery equipment—hydrotreaters and cokers—can be put into operation at a low capital cost.

The invention is illustrated by the following Examples in which all parts, proportions and percentages are by weight unless the contrary is stated.

EXAMPLE 1

This Example employed, as the liquid resid, an Arab Medium resid which in its untreated and hydrotreated forms had the analysis set out in Table 1 below:

TABLE 1

| Arab Medium Resid Composition | Untreated | Hydrotreated |
|---|---|---|
| Carbon, % | 83.63 | 84.92 |
| Hydrogen, % | 9.44 | 10.01 |
| Nitrogen, % | 0.48 | 0.53 |
| Sulfur, % | 5.60 | 3.25 |

The coal employed in this Example was a western, low-sulfur sub-bituminous coal (Wyodak-Belle Ayr) having the composition set out in Table 2 below (dry basis):

TABLE 2

| Wyodak-Belle Ayr Coal | Wt. Percent |
|---|---|
| Carbon | 63.8 |
| Hydrogen | 5.4 |
| Oxygen | 24.6 |
| Nitrogen | 1.1 |
| Sulfur | 0.4 |
| Ash | 4.6 |

When the hydrotreated resid was subjected to a simulated delayed coking by heating to 450° C. (840° F.) for 40 minutes in an autoclave, the coke yield was 19.5% and the sulfur content of the liquids was 3.3%. When subjected to the same treatment in the presence of the coal (30 parts of moisture, ash free coal to 100 parts of residue), the net coke yield (calculated for zero conversion of the coal) was lowered to 13.7% (29.7% reduction) and the sulfur content of the liquids to 2.9% (12% reduction).

By comparison, the non-hydrotreated resid when coked by itself under the same conditions gave a coke yield of 32% and a liquids sulfur content of 5.69%. When coked in the presence of coal (30 parts coal:100 parts resid, same coking conditions), the coke yield decreased by a relatively smaller proportion to 28.5%

(4.7% reduction) and the liquids sulfur content to 4.34% (23.7% reduction).

EXAMPLE 2

This Example employed, as the liquid resid, an Arab Light Vacuum resid which in its untreated and hydrotreated forms had the analyses set out in Table 3 below:

TABLE 3

| Arab Light Resid Composition | Untreated | Hydrotreated |
|---|---|---|
| Carbon, % | 84.6 | 84.6 |
| Hydrogen, % | 9.8 | 10.2 |
| Nitrogen, % | 0.9 | 0.36 |
| Sulfur, % | 4.4 | 3.54 |

When coked by itself (450° C., 40 mins.) the net yield on the hydrotreated resid was 45.8 percent distillate and 27.5 percent coke with a distillate sulfur content of 3.93 percent. When coked in the presence of the coal of Example 1 (30 parts coal: 100 parts resid, same coking conditions) the respective yields were 48 percent distillate and 23.4 percent coke, with a distillate sulfur content of 2.92 percent. The reduction in the sulfur content of the liquid distillate is attributed to the enhanced scavenging of sulfur by the solid residues when coal is present. In addition, the coke from the coal-resid coking contained only 3.5 percent sulfur as opposed to 5.7 percent sulfur produced by coking the resid on its own. The nickel and vanadium levels in the coke were also reduced to 33 and 98 ppm from 70 and 216 ppm, respectively, representing an approximate halving of the content of these metals.

The compositions and heating value of the co-processed coal/resid coke, as compared to that of the original coal, can be seen from Table 4 below which also includes the values for a theoretical 1:2 mixture of petroleum coke and coal, for comparison.

TABLE 4

| Heating Values of Solid Fuels | Belle Ayr Coal | Coal/Resid Coke | Coke/ Coal Mixture |
|---|---|---|---|
| Carbon, % | 63.8 | 83.2 | 71.5 |
| Hydrogen, % | 5.4 | 4.2 | 5.0 |
| Oxygen, % | 24.6 | 4.4 | 16.7 |
| Nitrogen, % | 1.1 | 1.0 | 1.1 |
| Sulfur, % | 0.4 | 4.3 | 2.6 |
| Ash, % | 4.6 | 3.0 | 3.1 |
| Heating Value, $kJ.kg^{-1}$. | 26096 | 34167 | 29444 |
| (BTU/lb) | (11,219) | (14,689) | (12,659) |

I claim:

1. A process for converting coal and liquid hydrocarbon residual materials to liquid products and coke which comprises:

hydrotreating a liquid residual material to produce distillate range material and partially convert heteroatom content to inorganic form;

separating distillate and heteroatom materials from the hydrotreated residual liquid;

comminuting the coal and mixing finely comminuted coal with the hydrotreated residual liquid in a ratio of about 0.5:1 to 10:1 parts by weight of residue per part of coal;

coking the hydrotreated residual material in the presence of the coal at a temperature of at least 400° C., whereby liquid product heteroatom content and coke yield obtained by coprocessing the coal and residual mixture are substantially lower than that amount produced by coking of the hydrotreated residual liquid alone.

2. A process according to claim 1 in which the liquid residual material comprises a petroleum residue having an initial boiling point above 480° C.

3. A process according to claim 1 in which the coal has an oxygen content of about 7 to 30 weight percent and a carbon content of not more than 75 weight percent (dry, ash-free basis).

4. A process according to claim 3 in which the coal is sub-bituminous and has a carbon content of 60 to 75 weight percent (dry, ash-free basis).

5. A process according to claim 3 in which the coal has a sulfur content of not more than 1.5 weight percent (dry, ash-free basis).

6. A process according to claim 1 in which the liquid residual material is mixed with comminuted low rank coal and the mixture subjected to delayed coking.

7. A process according to claim 1 in which the liquid residual material is mixed with comminuted coal and the mixture subjected to fluid coking.

8. A process according to claim 1 in which the ratio of the residual material to the coal is from 2.5:1 to 10:1, by weight.

9. A process according to claim 1 in which the mixture of residual material and coal is heated to a coking temperature of at least 450° C. prior to coking.

10. A process according to claim 1 wherein the residual liquid is catalytically hydrotreated in the presence of hydrogen at a temperature of about 300° to 450° C. employing an acidic catalyst having a hydrogenation component.

11. A process according to claim 1 wherein coker overhead products are fractionated and coker residual bottoms are recycled from product fractionation and combined with hydrotreated liquid and coal mixture.

12. A process according to claim 11 wherein the recycle constitutes about 20 to 40 weight percent of liquid coker feed.

13. A process for coprocessing a coker feed consisting essentially of petroleum residual liquid and low rank coal to yield high quality liquid products and coke, which comprises catalytically hydrotreating the residual liquid to convert at least a portion of heterocomponents including nitrogen or sulfur and produce distillate;

fractionating and mixing hydrotreated residual liquid with finely ground coal as coker feed;

heating the coker feed mixture to a temperature of at least about 450° C. under coking conditions sufficient to obtain a relatively low coke yield and distillate product low in nitrogen and sulfur content.

* * * * *